US005249383A

United States Patent [19]

McCusker et al.

[11] Patent Number: 5,249,383

[45] Date of Patent: Oct. 5, 1993

[54] CARD DISPLAY HOLDER AND PROTECTOR

[76] Inventors: Leo McCusker, 16 Cote Cir., Raymond, N.H. 03077; Javier Collao, 166 Greenwood Rd., Andover, Mass. 01810

[21] Appl. No.: 798,581

[22] Filed: Nov. 26, 1991

[51] Int. Cl.[5] ..... G09F 3/18

[52] U.S. Cl. ..... 40/642; 40/605

[58] Field of Search ..... 40/642, 611, 124.4, 40/152, 152.1, 605, 661; 206/455

[56] References Cited

U.S. PATENT DOCUMENTS

| | | | |
|---|---|---|---|
| 3,089,270 | 5/1963 | Shoemaker | 40/159.2 |
| 3,150,457 | 9/1964 | Thieme | 40/152 |
| 3,203,127 | 8/1965 | Pettersson | 40/152 |
| 3,470,643 | 10/1969 | Hans-Hermann Koeppe et al. | 40/152 |
| 4,250,641 | 2/1981 | Thompson | 40/159 X |
| 4,736,538 | 4/1988 | Pierce et al. | 40/156 X |
| 4,785,565 | 11/1988 | Kuffner | 40/605 |
| 4,829,691 | 5/1989 | Manjos et al. | 40/642 X |
| 4,972,952 | 11/1990 | Reiseneder | 206/455 |
| 4,979,619 | 12/1990 | Hager | 40/156 X |

*Primary Examiner*—Kenneth J. Dorner
*Assistant Examiner*—J. Bonifanti
*Attorney, Agent, or Firm*—Edward A. Gordon

[57] ABSTRACT

A plastic display device for holding and protecting a card or card-like display item including a rectangular front section having a top surface and a bottom surface and a rectangular rear section having a top and bottom surface and conforming in area to the front section. The front and rear sections have corresponding frame structures comprising top walls, side walls and bottom walls. Transparent panel sections extend about the front and rear portions of the frame structures and together with the frame structures form a chamber of sufficient size for receiving a card or card-like display item. The chamber may have an area that is slightly greater than the card. A slot is formed between the corresponding bottom wall sections having a width equal to or slightly greater than the width of the chamber and extending from the bottom surface of the card display holder and protector device to a connecting device, which forms the bottom surface of the chamber and provides access to the chamber for inserting a card and includes a first rib member extending inwardly along the top surface of one bottom wall section and a mating second rib member extending inwardly below the first rib member from the adjacent bottom wall section. The front bottom wall section and the adjacent rear bottom wall section are sufficiently flexible so that each lateral side of the bottom wall portion of the card holder and protector device can be compressed whereby the connecting device can be sufficiently moved apart in a curve-like configuration whereby a card or card-like display item can be inserted through the slot into the chamber. In a preferred embodiment the card holder and protector device is provided with grooves for detaching the lower portion of the card device from a position adjacent the lower end of the card chamber. Also in a preferred embodiment, the front surface of the bottom wall section is provided with a recessed section for releasably containing information items.

13 Claims, 5 Drawing Sheets

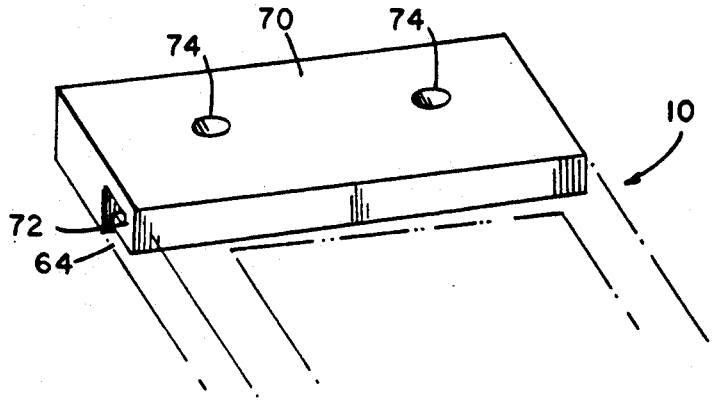
FIG.8
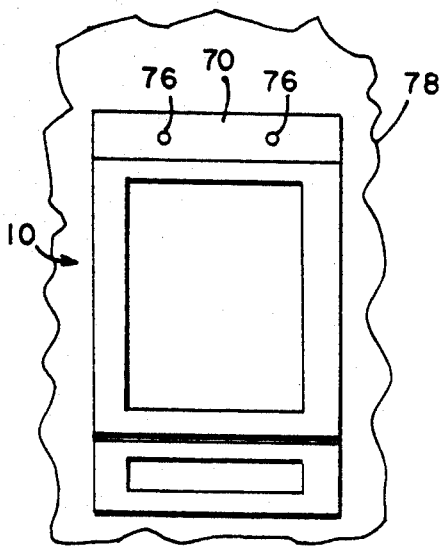
FIG.8A
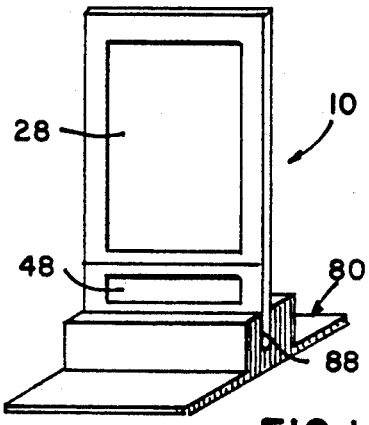
FIG.14A
FIG.14
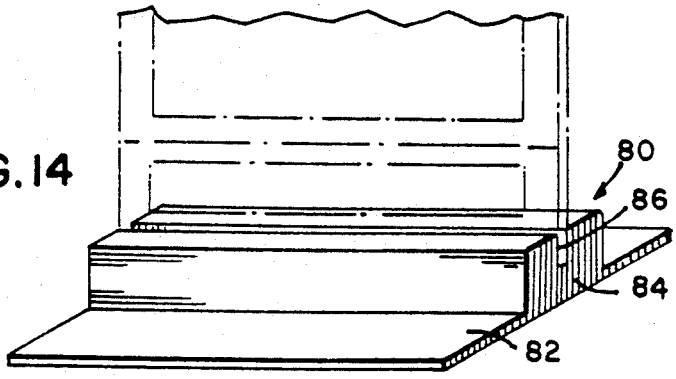

CARD DISPLAY HOLDER AND PROTECTOR

BACKGROUND OF THE INVENTION

1. Field Of The Invention

The present invention relates generally to display devices and more particularly to a display device which functions as a holder, protector and storage for an image bearing card such as, for example, a baseball sports card.

2. Description Of Prior Art

There are various types of prior art card holder and protector devices. U.S. Pat. No. 4,829,691 discloses a display and protector device having transparent first and second panels connected together along a common hinge line. The first panel has a recessed portion having a depth for receiving the card to be held and contacting the first surface of the card while the second panel has a projecting surface which is less than the depth of the recessed bottom surface of the first panel equal to the approximate thickness of the card whereby the panels are engaged together thereby allowing display of the card.

U.S. Pat. No. 5,010,673 discloses a plastic card holder having a clear base panel with a top surface that has a recessed portion for containing the display card and a plurality of flanges along the periphery of the base panel and extending upwardly to receive the insert transparent panel cover which has angled corners or notches around the periphery in positions corresponding to the flange on the base panel for releasably mating the base and insert panel.

U.S. Pat. No. 3,200,527 to Clark discloses a hinged snap-lock container for holding, for exposure or viewing, film transparencies, photographs or paintings. The container of Clark has a front and a back panel which are attached by a thin integral hinged line 15 as shown in FIG. 2 of the patent. A plurality of snap-lock portions are provided on the inside surface of the front and back panels to enable the front and back panels to be secured to each other.

U.S. Pat. No. 1,932,464 to Hyde discloses a lantern slide holder which also has a hinged line 15, but the front and back panels are secured together after folding along the hinged line by a plurality of flaps, for example, flaps 8, 9 and 10 as shown in FIG. 1 thereof.

The following U.S. patents are believed to exemplify the present state of the art with respect to displaying sportscards and other related materials: U.S. Pat. Nos. 4,995,508 4,419,837 3,735,516.

While such prior art devices provide improvement in the areas intended, there still exists a great need for a device which displays and protects a single card which provides a new and improved construction and use.

Accordingly, a principle desirable object of the present invention is to provide a new and improved card display device for displaying, holding and protecting a single card.

Another desirable object of the present invention is to provide a card display holder and protector which maintains the card in the condition received.

Another desirable object of the present invention is to provide a card display holder and protector which protects the card from being damaged while securing the display card in the card holder.

A further desirable object of the present invention is to provide a card display holder and protector which is constructed and arranged to be releasably attached to one or more of the same card display holders for display purposes.

Another desirable object of the present invention is to provide a card display holder and protector which is constructed and arranged to be releasably attached to the same other card holders to form a page of cards for placement in an album or the like.

Another desirable object of the present invention is to provide a card display holder and protector device in accordance with the foregoing desirable objects which may be economically manufactured and be of durable character.

These and other desirable objects of the present invention will in part appear hereinafter and will in part become apparent after consideration of the specification with reference to the drawings and the claims.

SUMMARY OF THE INVENTION

The present invention is a plastic display device for holding and protecting a card or card-like display item including a rectangular front section having a top surface and a bottom surface and a rectangular rear section having a top and bottom surface and conforming in area to the front section. The front and rear sections have corresponding frame structures comprising top walls, side walls and bottom walls. Transparent panel sections extend about the front and rear portions of the frame structures and together with the frame structures form a chamber of sufficient size for receiving a card or card-like display item. The chamber may have an area that is slightly greater than the card. A slot is formed between the corresponding bottom wall sections having a width equal to the width of the chamber and extending from the bottom surface of the card display holding and protecting device to a connecting means for the adjacent bottom wall. The connecting means, which forms the bottom surface of the chamber and provides access to the chamber for inserting a card, includes a first rib member extending inwardly along the top surface of the bottom wall of the rear section and a mating second rib member extending inwardly below the first rib member from the bottom wall of the front section. The front bottom wall member and the adjacent rear bottom wall member are sufficiently flexible so that the bottom wall portion of the card holder and protector can be compressed simultaneously from each lateral side whereby the connecting means can be sufficiently moved apart in a curve-like configuration whereby a card or card-like display item can be inserted through the slot into the chamber. Once the card is inserted into the chamber and the compression released, it is extremely difficult to remove the card from the slot. In this respect the card holder and protector device is provided with means for detaching the lower portion of the card device from a position adjacent the lower end of the card chamber. In a preferred embodiment, the front surface of the bottom wall section is provided with a recessed section within which an information item such as, for example, a sticker or card member describing the display card and/or the cost thereof, for example, can be inserted.

BRIEF DESCRIPTION OF THE DRAWINGS

For a fuller understanding of the nature and desired objects of the present invention, reference should be made to the following detailed description taken in conjunction with the accompanying drawings wherein like reference characters denote corresponding parts throughout several views and wherein:

FIG. 8 is a perspective view of a mounting device in accordance with the present invention showing how it is attachable to the top of the card holder and protector device of the embodiment shown in FIG. 5 and shown in a fragmentary dotted line form;

FIG. 8A is a fragmentary front plan view showing the mounting device secured to the top of the card holder and protector device as shown in FIG. 8 and mounted on a support member;

FIG. 14 is a perspective view of a support means in accordance with the present invention for displaying a card holder and protector device of the present invention which is shown in fragmentary dotted line form;

FIG. 14A is a perspective view of a support means for the card holder and protector device in accordance with the present invention.

DETAILED DESCRIPTION OF PREFERRED EMBODIMENT(S)

Figure 1:
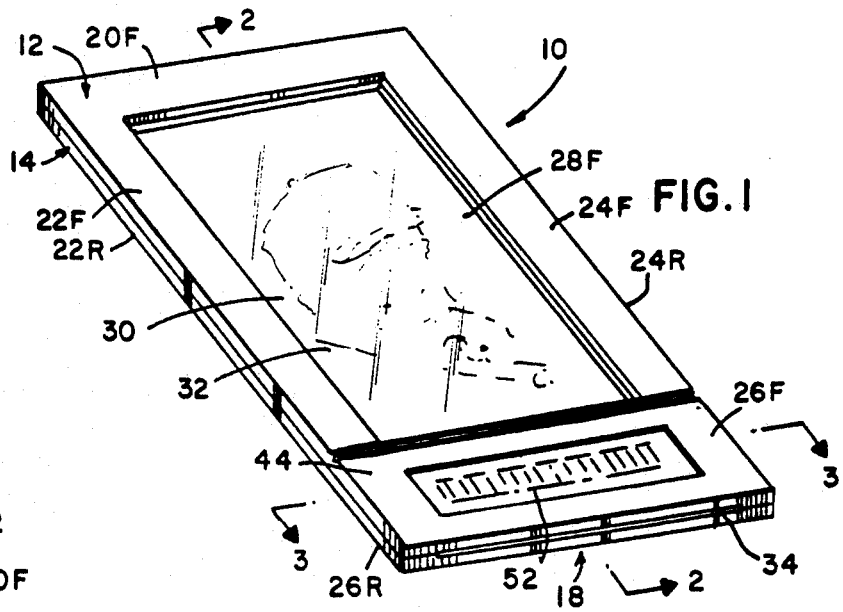
FIG. 1 is a fragmentary front and side perspective view of a card display holder and protection device embodying the principles of the present invention and also showing a card being positioned within the holder for protection; p

Referring now to the drawings and more particularly to FIGS. 1–4, there is illustrated one embodiment of a display device for holding and protecting a card or card-like display item, indicated generally by the numeral 10, embodying the principles of the present invention. The card display holder and protector device 10, hereinafter also referred to as the card holder and protector, includes a rectangular front section 12 and a corresponding rear section 14. The card display holder and protector device 10 includes a top surface 16 and a bottom surface 18. The front and rear sections 12 and 14 have corresponding frame structures comprising top wall sections 20F and 20R, side wall sections 22F, 22R and 24F, 24R and bottom wall sections 26F and 26R. A pair of transparent members 28F and 28R formed of transparent plastic such as, for example, polyvinyl chloride extend about the front and rear wall sections and form a chamber means 30 therebetween of sufficient size to receive a card or card-like display item such as card 32 discussed hereinafter particularly with respect to FIG. 4.

The card holder and protector device 10 includes a slot 34 formed between the bottom wall sections 26F and 26R having a width equal to or slightly greater than the width of the chamber 30 and extending from the bottom surface 18 of the card holder and protector device 10 to the connecting means 38 which includes a rib member 40 attached to or formed on the inner surface 36 of the front bottom wall section 26F adjacent the top of the slot 34 and extending inwardly and a similar adjacent rib member 42 attached to the inner surface of the rear bottom wall section 26R and extending inwardly over the rib member 40 and forming the base of the chamber 30.

Figure 2:
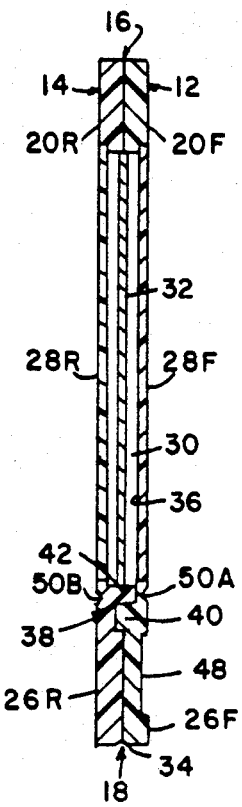
FIG. 2 is a cross-sectional view of the card holder and protector device taken along the line 2—2 of FIG. 1.
Figure 3:
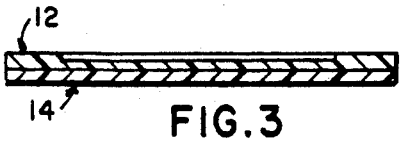
FIG. 3 is a cross-sectional view of the card display holder and protector device taken along the line 3—3 of FIG. 1.
Figure 4:
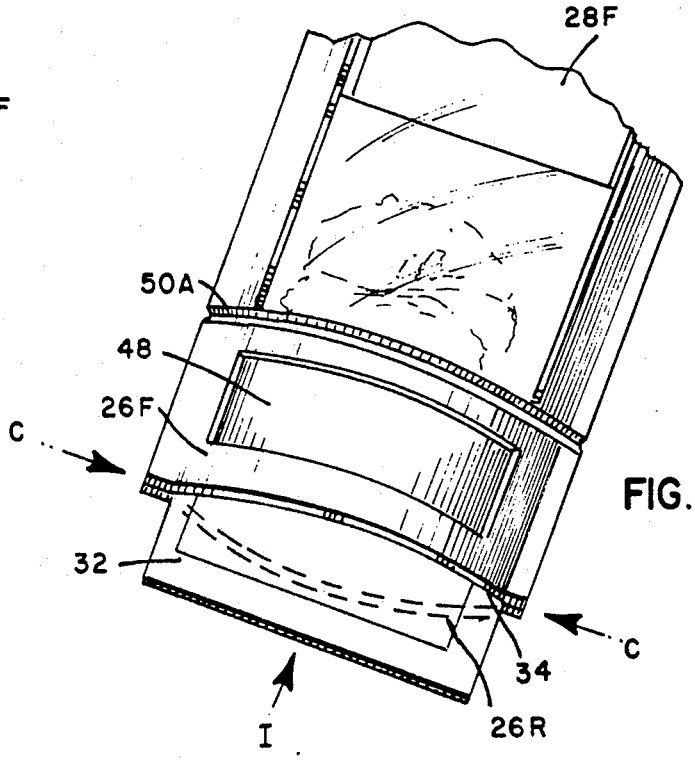
FIG. 4 is a fragmentary front perspective view showing a card being inserted into the card display holder and protector of FIG. 1.

The card holder and protector device 10 is preferably formed of a plastic material such as, for example, polyvinyl chloride (PVC) or polystyrene, although other plastics can be used, of sufficient thickness so that the bottom wall sections 26F and 26R can be sufficiently flexible so that (as shown in FIG. 4) at least the bottom portions, 26F and 26R, of the card holder and protector device 10 can be compressed manually, for example, inwardly as shown by the arrows C whereby the rib members 40 and 42 of the connecting means 38 can be sufficiently moved apart or in a curve-like configuration whereby a card or card-like display item such as card member 32 can be inserted through the slot 34 into the chamber 30. When the card member 32 is inserted into the chamber 30 as shown by the arrow I and the compression released, the rib members 40 and 42 close as shown in FIG. 2 and prevent the card member 32 from being removed.

The upper portion of the front bottom wall section 26F is provided with a horizontal groove 50A preferably having a V-shaped configuration extending across the card holder device 10 adjacent to the bottom portion of the panel member 28F. A corresponding groove 50B extends across the rear bottom wall section 26R. The grooves 50A and 50B permit the base sections 26F and 26R to be manually detached to allow for removal of the card 32.

In a preferred embodiment, the front surface 44 of the bottom wall section 26F is formed with a recessed section 48, which, for example, is rectangular and has a depth within which an information item 52 such as stickers or card members, for example, as shown in FIG. 1, can be inserted and releasably attached by a suitable conventional adhesive material (not shown). In another embodiment, a panel of transparent plastic (not shown) can be attached to the recessed section 48 to form a pocket means with a slot or opening along the top to receive an information item 52.

Referring now more particularly to FIGS. 5-11, there is illustrated an alternate embodiment of the card holder and protector device 10. In the embodiment illustrated in FIGS. 5-7, the right side of the card holder and protector device 10 is provided with a coupling means 54 extending outwardly from the right side of the front section 14. The coupling means 54, hereinafter also referred to as an upper coupling means 54, includes an upper section 56, a vertical section 58 which extends downwardly one half of the distance from the top surface 15 of the front section 14 to the bottom surface 17 of the rear section 12, and a horizontal section 60 which extends inwardly approximately one half the length of the opposing section 56.

Figure 5:
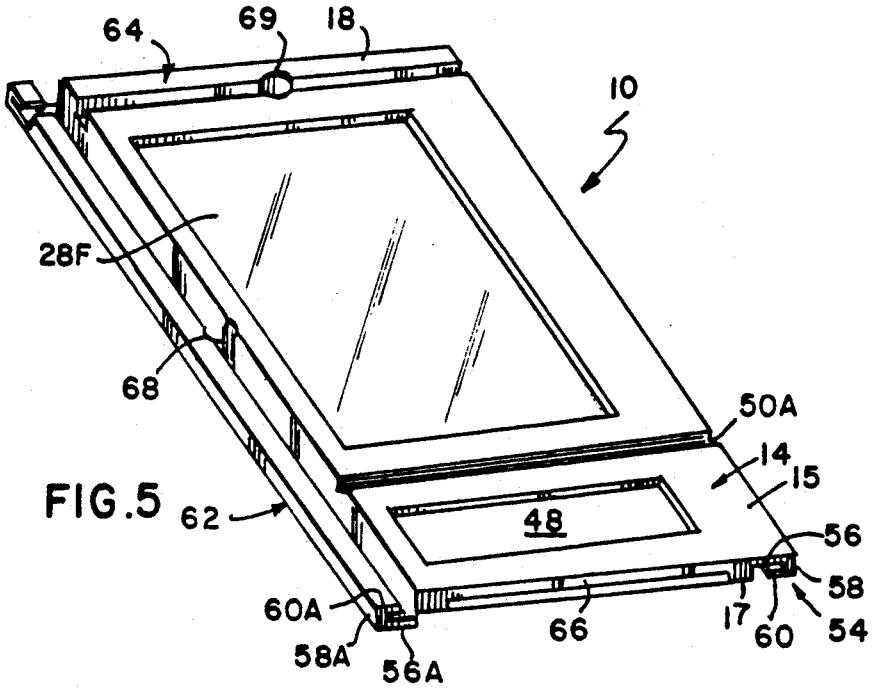
FIG. 5 is a front and side perspective view of an alternate embodiment of a card display holder and protector device embodying the principles of the present invention.
Figure 6:
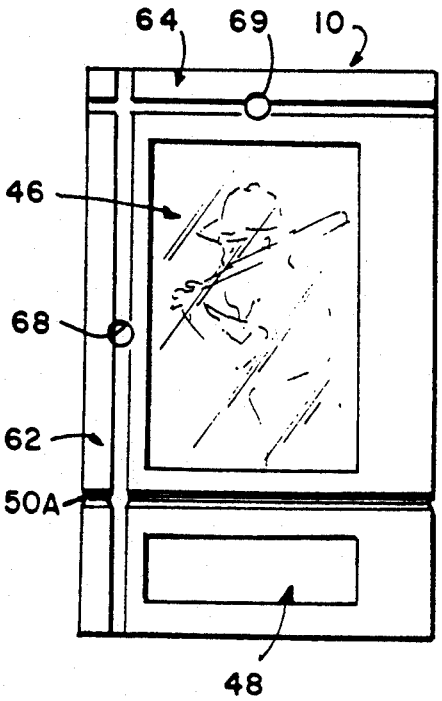
FIG. 6 is a front elevational view of the card display holder and protector device of FIG. 5 and showing the front view of a card to be displayed inserted within the holder.
Figure 7:
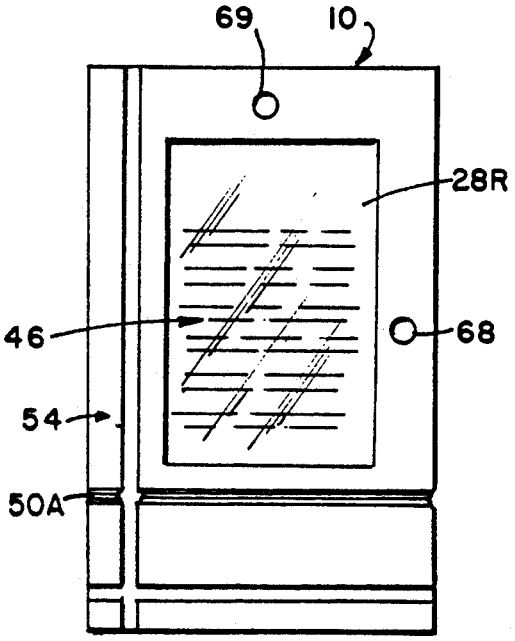
FIG. 7 is a rear elevational view of the card display holder and protector device of FIG. 5 and showing the rear view of the card shown in FIG. 6 inserted within the holder.

In a similar manner the left or other side of the card holder and protector device 10 is provided with a coupling means 62 extending upwardly, hereinafter also referred to as an upper coupling means 62. The coupling means 62 is constructed with similar sections 56A-60A as the lower coupling means 54. Also in the same manner the top and bottom surfaces 16 and 18 of the card holder and protector 10 are provided respectively with a lower coupling means 64 (as best seen in FIGS. 5 and 6) and an upper coupling means 66 (as best seen in FIG. 7). Also the card holder and protector device 10 may be provided with at least one hole 68 defined by the left side wall sections 22F and 22R and at least one hole 69 defined by the upper wall sections 20F and 20R to permit the card holder and protector device 10 to be placed in a conventional album, for example, and attached to conventional ring members in such an album (not shown) when card members, such as 46 as shown in FIGS. 6 and 7 are inserted into the card holder and protector device 10, for example, have a picture on the front as shown in FIG. 6 and a written description on the back as shown in FIG. 7.

Referring now more particularly to FIGS. 8 and 8A, the embodiment of the card holder and protector 10 illustrated in FIG. 5 includes a top mounting member 70 which comprises an upper coupling means 72 for releasably fastening the mounting member 70 to the lower coupling means 64 provided at the top surface 16 of the card holder and protector device 10.

The mounting member 70 is provided with holes or apertures 74 which provide for the mounting member 70 and the attached card holder and protector 10 to be hung upon hook members 76 which are attached to a selected support member 78 which represents, for example, a wall or display panel member.

Figure 9:
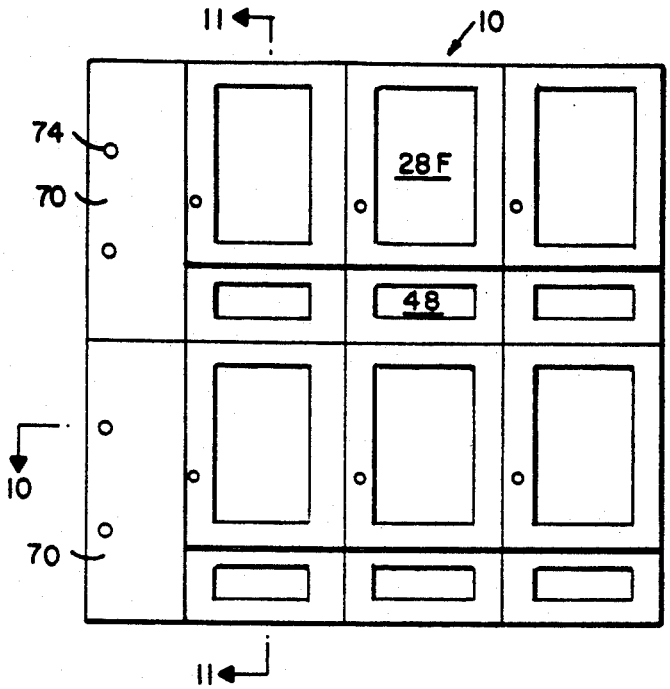
FIG. 9 is a top elevation view showing a pair of mounting devices and a plurality of card display holder and protector devices in releasably fastened relationship.
Figure 10:
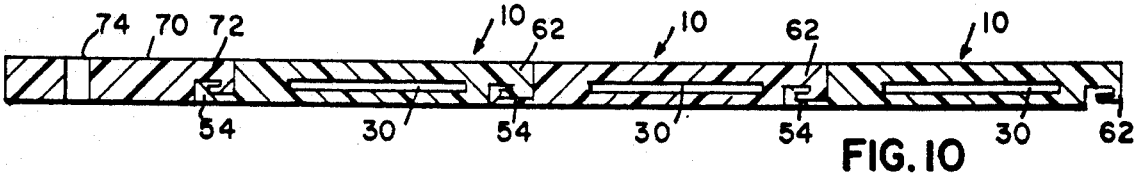
FIG. 10 is a cross-sectional view taken along the line 10—10 of FIG. 9 showing how the card display holder and protector devices are vertically releasably attached to each other.
Figure 11:
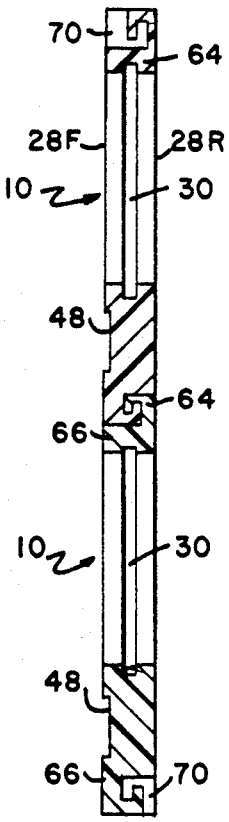
FIG. 11 is a cross-sectional view taken along the line 11—11 of FIG. 9 showing how the mounting devices and card display holder and protector devices are laterally releasably attached to each other.

Referring now to FIGS. 9-11, there is illustrated an example of using the card holder and protector device 10 of the present invention which includes inserting the cards to be displayed and protected in each card holder and protector device 10 and the steps of attaching the side coupling means 62 and 54 of each adjacent card holder and protector 10 to form two rows of three holders each, for example. Thereafter, the bottom coupling means 66 of the top row of card holders 10 are each attached to the respective top coupling means 64 of the bottom row of card holders 10. The assembly of card display holder and protector devices 10 may be provided with mounting members 70 which are provided with a longer length equal to the length of the side of the card holder 10 whereby the coupling means 72 of each mounting member 70 is attached to the mating coupling means 62 of each card holder and protector device 10. In this manner, for example, the holes 74 of the mounting members 70 may be inserted into conventional ring binders (not shown). It is also to be understood that the present invention includes mounting members 70 of different lengths and widths and a various number of holes of different sizes and shapes.

Figure 12:
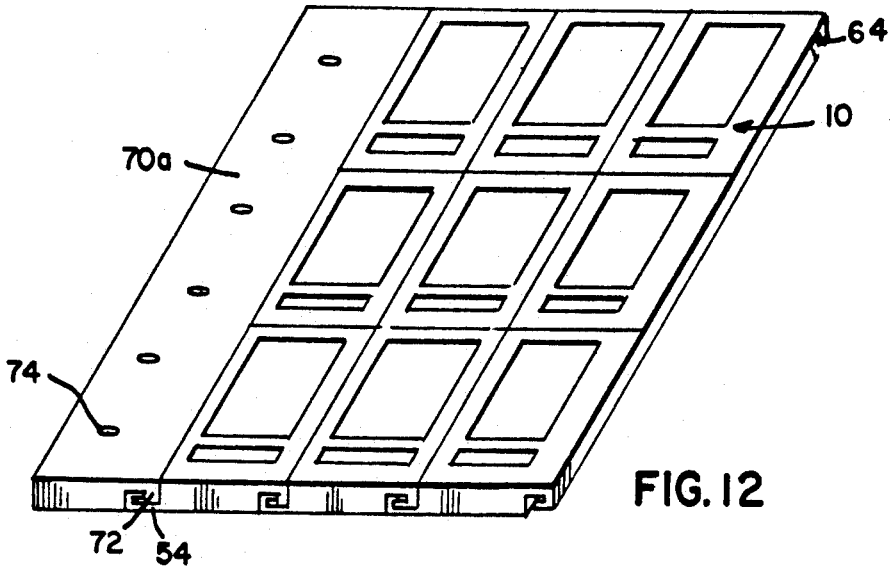
FIG. 12 is a perspective view showing an alternate embodiment of an elongated mounting device and a plurality of card display holder and protector devices in releasably fastened relationship.

As shown in FIG. 12, the mounting member **70*a* is of a sufficient length so that the coupling means 72 can receive the coupling mean 54 of each adjacent card holder and protector 10** forming three rows, for example.

Figure 13:
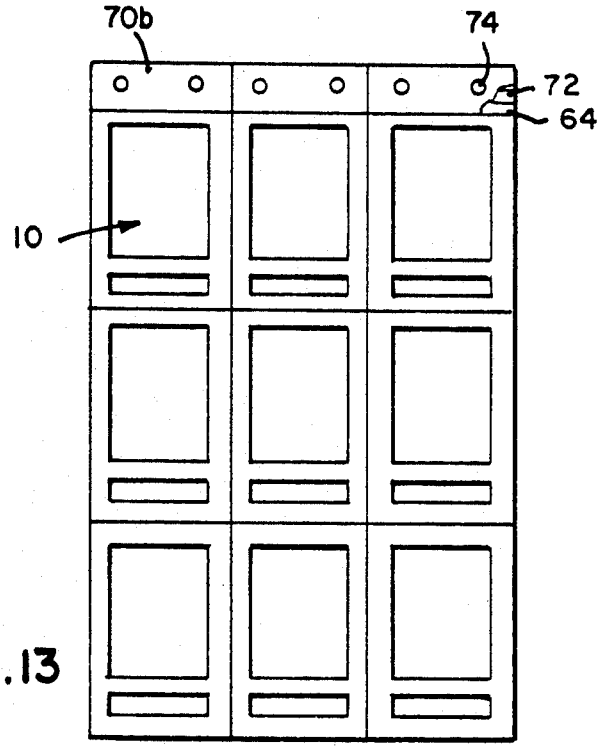
FIG. 13 is a top elevation view of an alternate mounting arrangement of the elongated mounting device and the plurality of card display holder and protector devices of FIG. 12.

Referring now to FIG. 13, there is illustrated an alternate mounting arrangement in which the coupling means 72 of the mounting member **70*b* is coupled to top coupling means 64 of each of the holder and protector devices 10**.

As shown in FIGS. 14 and 14A, the present invention also includes a support means 80 which includes a base member 82 and a vertical support member 84 having an upper slot 86 to releasably receive a portion 88 of the bottom sections 26F and 26R of the card holder and protector device 10 to support the card holder and protector device 10 in an upright display position.

Figure 15:
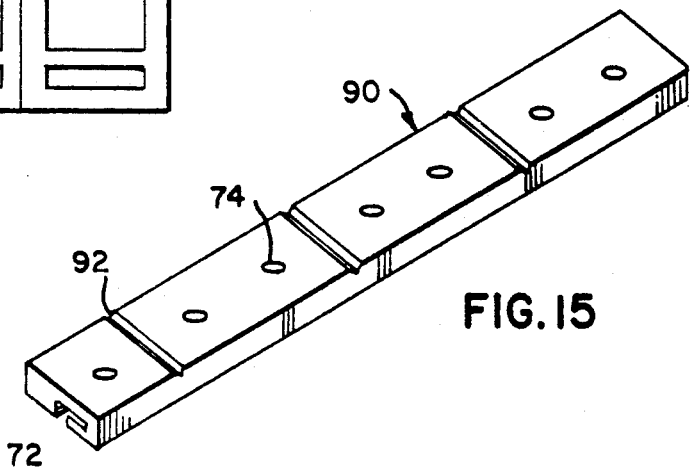
FIG. 15 is a perspective view of an alternate embodiment of a mounting device in accordance with the present invention.

Referring now to FIG. 15, there is illustrated an alternate embodiment of the mounting member of the present invention. As shown, the mounting member 90 is elongated and provided with a coupling means 72, holes 74 and slits or grooves 92 which permit the mounting member 90 to be detached into sections of selected lengths and holes for mounting the card holder and protector devices 10.

The present invention also contemplates that the card holder and protector device 10 can be formed or different colors such as, for example, different colored plastic material.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawings, shall be interpreted as illustrative and not in a limiting sense.

What is claimed is:

1. A plastic display device for holding and protecting a card or card-like display item said display device comprising:

a rectangular member having front and rear surfaces and top and bottom surfaces; said rectangular member having a frame structure comprising a top wall, side walls and a bottom wall;

a first transparent panel section extending about the front surface of the frame structure;

a second transparent panel section extending about the rear surface of the frame structure;

said frame structure and front and rear panel sections forming a chamber means of sufficient size for receiving a care or card-like display item;

groove means horizontally disposed along the front section below the chamber and a corresponding groove means disposed along the base section whereby the base sections can be detached to provide removal of a card display item from the chamber means;

a rectangular slot means having front, rear and side surface walls and a width at least equal to the width of the chamber means and extending from the bottom surface of the rectangular member to a connecting means;

said connecting means comprising a first rib member extending inwardly along the rear surface of said slot means and forming the lower surface of said chamber means, and a mating second rib member extending inwardly along the front surface of said slot means and below said first rib member;

said rectangular member being sufficiently flexible whereby said connecting means can be sufficiently moved apart whereby a card of card-like display item can be inserted through the slot means and connecting means into the chamber means.

2. A plastic display device for holding and protecting a card or card-like display item, said display device comprising:

a rectangular front section and a rectangular rear section conforming in area to the front section;

said front and rear sections being attached together and having a top surface and a bottom surface;

said front and rear sections having corresponding frame structures comprising top walls, side walls and bottom walls;

a first transparent panel section extending about the outer portion of the frame structure of the front section;

a second transparent panel section extending about the outer portion of the frame structure of the rear section;

said front and rear frame structures and corresponding first and second panel sections forming a chamber means of sufficient size for receiving a card or card-like display item;

groove means horizontally disposed along the front section below the chamber and a corresponding groove means disposed along the base section whereby the base sections can be detached to provide removal of a card display item from the chamber means;

a connecting means forming the base section of the chamber means, said connecting means comprising a first rib member extending inwardly along the inner surface of one bottom wall and forming the lower surface of said chamber means and a mating second rib member extending inwardly and along the other bottom wall below the first rib member; and slot means formed between the bottom walls of the front and rear sections; said slot means having a width at least equal to the width of the chamber means and extending from the bottom surface of said front and rear sections up to said connecting means;

said adjacent bottom wall sections being sufficiently flexible whereby said connecting means can be sufficiently moved apart whereby a card or card-like display item can be inserted through the slot means and the connecting means into the chamber means.

3. The plastic display device for holding and protecting a card or card-like display item according to claim 2, further comprising each lateral side having a coupling means adapted for releasably securing to a mating coupling means on similar configured plastic display devices.

4. The plastic display device for holding and protecting a card or card-like display item according to claim 2, further comprising the top and bottom sides having a coupling means adapted for releasably securing to a mating coupling means on similar configured plastic display devices.

5. The plastic display device for holding and protecting a card or card-like display item according to claim 2, wherein the front bottom wall further comprises a recessed section for releasably containing information items.

6. The plastic display device for holding and protecting a card or card-like display item according to claims 1 or 2, further comprising a support means for releasably receiving a portion of the bottom of the plastic display device for holding and protecting a card or card-like display item in an upright position for viewing the display item.

7. A plastic display device for holding and protecting a card or card-like display item, said display device comprising:

rectangular front and rear sections attached together and having top, bottom and side surfaces;

said front and rear rectangular sections having corresponding frame structures comprising top walls, side walls and bottom walls;

a first transparent panel section extending about the outer portion of the frame structure of the front section;

a second transparent panel section extending about the outer portion of the frame structure of the rear section;

said front and rear frame structures and corresponding first and second panel sections forming a chamber means of sufficient size for receiving a card or card-like display item;

groove means horizontally disposed along the front section below the chamber and a corresponding groove means disposed along the base section whereby the base sections can be detached to provide removal of a card display item from the chamber means;

the periphery of the top, bottom and side surfaces each having coupling means adapted for releasably securing to a mating coupling means on a similar configured plastic display device;

a connecting means forming the base section of the chamber means, said connecting means comprising a first rib member extending inwardly along the inner surface of one bottom wall and forming the lower surface of said chamber means, and a mating second rib member extending inwardly along the other bottom wall and below the first rib member; and slot means formed between the bottom walls of the front and rear sections; said slot means having a width at least equal to the width of the chamber means and extending from the bottom surface of said front and rear sections to said connecting means;

said adjacent bottom wall sections being sufficiently flexible whereby said connecting means can be sufficiently moved apart whereby a card or card-like display item can be inserted through the slot means and connecting means into the chamber means.

8. The plastic display device for holding and protecting a card or card-like display item according to claim 7, further including a rectangular mounting member having elongated side surfaces and a coupling means formed along one side surface for releasably attaching to at least one plastic display device having a mating coupling means formed on at least one side surface thereof.

9. The plastic display device for holding and protecting a card or card-like display item according to claim 8, further comprising the rectangular mounting member having at least one hole portion between the elongated side surfaces for facilitating the attaching of the mounting member to a hook device.

10. The plastic display device for holding and protecting a card or card-like display item according to claims 8 or 9, further comprising an elongated mounting member having a plurality of hole portions between the side surfaces and a plurality of groove means disposed laterally between said side surfaces and in spaced relationship to each other whereby sections of the mounting member defined by selected grooves are detachable to thereby provide a mounting member of selected length.

11. The plastic display device for holding and protecting a card or card-like display item according to claim 7, wherein the front bottom wall further comprises a recessed section for releasably containing information items.

12. The plastic display device for holding and protecting a card or card-like display item according to claims 3, 4 or 7 in which at least the coupling means on the left and top sides have at least one aperture to enable said display device to be releasably attached to ring binders.

13. A plastic display device for holding and protecting a card or card-like display item, said display device comprising:

rectangular front and rear sections attached together and having top, bottom and side surfaces;

said front and rear rectangular sections having corresponding frame structures comprising top walls, side walls and bottom walls;

a first transparent panel section extending about the outer portion of the frame structure of the front section;

a second transparent panel section extending about the outer portion of the frame structure of the rear section;

said front and rear frame structures and corresponding first and second panel sections forming a chamber means of sufficient size for receiving a card of card-like display item;

groove means horizontally disposed along the front section below the chamber and a corresponding groove means disposed along the rear section whereby the base sections can be detached to provide removal of a card display item from the chamber means;

the periphery of the top, bottom and side surfaces each having coupling means adapted for releasably securing to a mating coupling means on a similar configured plastic display device;

said coupling means on at least the left and top side surfaces having at least one aperture to enable said display device to be releasably attached to a hook means;

a connecting means forming the base section of the chamber means, said connecting means comprising a first rib member extending inwardly along the inner surface of one bottom wall and forming the lower surface of said chamber means, and a mating second rib member extending inwardly along the other bottom wall and below the first rib member;

slot means formed between the bottom walls of the front and rear sections; said slot means having a width at least equal to the width of the chamber means and extending from the bottom surface of said front and rear sections to said connecting means;

said adjacent bottom wall sections being sufficiently flexible whereby said connecting means can be sufficiently moved apart whereby a card or card-like display item can be inserted through the slot means and connecting means into the chamber means; and the front bottom wall section comprises a recess means for releasably containing information items.

* * * * *